US010902996B2

(12) United States Patent
Zhou et al.

(10) Patent No.: US 10,902,996 B2
(45) Date of Patent: Jan. 26, 2021

(54) SELF-CLAMPING STRUCTURE FOR SOLVING SHORT-CIRCUIT RESISTANCE PROBLEM OF AMORPHOUS ALLOY TRANSFORMERS

(71) Applicant: JIANGSU HUAPENG TRANSFORMER CO., LTD., Changzhou (CN)

(72) Inventors: Guowei Zhou, Changzhou (CN); Yuanben Huang, Changzhou (CN); Guojun Peng, Changzhou (CN); Wenjun Zhao, Changzhou (CN)

(73) Assignee: JIANGSU HUAPENG TRANSFORMER CO., LTD., Jiangsu (CN)

( * ) Notice: Subject to any disclaimer, the term of this patent is extended or adjusted under 35 U.S.C. 154(b) by 233 days.

(21) Appl. No.: 15/772,466

(22) PCT Filed: Nov. 10, 2015

(86) PCT No.: PCT/CN2015/094190
§ 371 (c)(1),
(2) Date: Apr. 30, 2018

(87) PCT Pub. No.: WO2017/070986
PCT Pub. Date: May 4, 2017

(65) Prior Publication Data

US 2018/0323004 A1 Nov. 8, 2018

(30) Foreign Application Priority Data

Oct. 30, 2015 (CN) ..... 2015 1 0729279

(51) Int. Cl.
*H01F 27/30* (2006.01)
*H01F 27/28* (2006.01)
(Continued)

(52) U.S. Cl.
CPC ..... *H01F 27/30* (2013.01); *H01F 27/288* (2013.01); *H01F 27/32* (2013.01); *H01F 27/402* (2013.01)

(58) Field of Classification Search
CPC ..... H01F 27/30; H01F 27/306; H01F 27/32; H01F 30/12
See application file for complete search history.

(56) References Cited

U.S. PATENT DOCUMENTS 3,302,149 A * 1/1967 Forsha ..... H01F 27/322 336/58
3,386,058 A * 5/1968 Michel ..... H01F 27/303 336/60
(Continued)

FOREIGN PATENT DOCUMENTS

CN 101692389 A 4/2010
CN 201570357 U 9/2010
(Continued)

OTHER PUBLICATIONS

International Search Report; dated Jun. 7, 2016 for International Application No. PCT/CN2015/094190.

*Primary Examiner* — Elvin G Enad
*Assistant Examiner* — Malcolm Barnes
(74) *Attorney, Agent, or Firm* — Dinsmore & Shohl LLP

(57) ABSTRACT

A self-clamping structure for solving a short-circuit resistance problem of amorphous alloy transformers comprises an A-phase coil, a B-phase coil and a C-phase coil which are horizontally arranged, the A-phase coil being in close contact with the B-phase coil, and the B-phase coil being in close contact with the C-phase coil. By using a solidified low-voltage coil as a fastening splint and binding with a high-strength binding strap, the low-voltage coils of the A-phase and the B-phase clamp and fix a weak portion between the A and B phases; and the low-voltage coil of the
(Continued)

B-phase and the C-phase clamp and fix a weak portion between the B and C phases. Outer sides of the A- and C-phase coils are each provided with a high-strength insulation splint, so that the splint and the low-voltage coil of corresponding phase constitute the splint pair to clamp and fix the corresponding weak portion.

17 Claims, 3 Drawing Sheets

(51) Int. Cl.
*H01F 27/32* (2006.01)
*H01F 27/40* (2006.01)

(56) References Cited

U.S. PATENT DOCUMENTS 3,436,704 A * 4/1969 Palumbo ..... H01F 27/362 336/70
3,579,163 A * 5/1971 Cronin ..... H01F 27/02 336/94
3,789,337 A * 1/1974 Sheppard ..... H01F 27/303 336/60
4,173,747 A * 11/1979 Grimes ..... H01F 27/322 336/206
4,837,543 A * 6/1989 Humen ..... H01F 27/02 336/196
5,321,379 A * 6/1994 Martin ..... H01F 27/324 206/563
5,331,304 A * 7/1994 White ..... H01F 27/25 336/206
2007/0247266 A1* 10/2007 Yargole ..... H01F 27/085 336/61
2013/0106547 A1* 5/2013 Takahashi ..... H01F 27/306 336/60
2015/0015355 A1* 1/2015 Brendel ..... B32B 21/00 336/58

FOREIGN PATENT DOCUMENTS

CN 201820614 U 5/2011
CN 103730243 A 4/2014
CN 105097234 A * 11/2015
JP 04326502 A * 11/1992
JP 5618404 A 1/2012
WO 2014132451 A1 9/2014

* cited by examiner

SELF-CLAMPING STRUCTURE FOR SOLVING SHORT-CIRCUIT RESISTANCE PROBLEM OF AMORPHOUS ALLOY TRANSFORMERS

TECHNICAL FIELD

The present disclosure relates to the field of transformers, and in particular to a self-clamping structure for solving the short-circuit resistance problem (the problem of resisting short circuit) of amorphous alloy transformers.

BACKGROUND ART

A coil of an amorphous alloy transformer is mainly composed of a high-voltage coil, a low-voltage coil, an insulator and so on, and the high- and low-voltage coils of the transformer are wound in one piece. Since an iron core of the amorphous transformer is not capable of bearing force and the coil of the amorphous transformer is mostly in a rectangular shape, the low-voltage coil cannot be tightly expanded by the iron core of the amorphous transformer, and a straight-side portion of the rectangular coil has a poor resistance to short circuit. When the transformer is short-circuited, the coil, subjected to actions of an axial force and a radial force, is prone to excessive deformation or short-circuit damage.

At present, in order to strengthen the strength of the coil of the amorphous transformer, the coil is generally reinforced by impregnating the coil with varnish, adding an epoxy bobbin (epoxy cylinder skeleton) in the low-voltage coil, and the like. However, all of these methods have disadvantages such as being material consuming and time consuming, and having complicated structures and processes, cumbersome winding operation, poor reliability, etc.

SUMMARY

The technical problem to be solved by the present disclosure is to propose a self-clamping structure for solving the short-circuit resistance problem of amorphous alloy transformers. This concept and structure solve the disadvantages such as having complicated structure and cumbersome winding operation and being material consuming and time consuming described in the background art, and are both simple and reliable.

The technical solution adopted by the present disclosure is directed to: a self-clamping structure for solving the short-circuit resistance problem of an amorphous alloy transformer, comprising coils of three phases of A, B and C (an A-phase coil, a B-phase coil and a C-phase coil) which are horizontally arranged, wherein the A-phase coil is adjacent to and in close contact with the B-phase coil, and the B-phase coil is adjacent to and in close contact with the C-phase coil; the A-phase coil, the B-phase coil and the C-phase coil each comprise a high-voltage coil located at an outer side and a low-voltage coil located at an inner side; the low-voltage coil has a certain mechanical strength after being solidified; the low-voltage coils of two adjacent phases are bound to each other by a binding strap; and the low-voltage coils of two adjacent phases form a "splint pair (clamp plate pair)" to clamp and fix the high-voltage coils of the two adjacent phases; and the high-voltage coils and the low-voltage coils are fixed to form one piece after being bound.

Further, the low-voltage coil described in the present disclosure is a foil-wound coil formed by winding copper foils, and is in a multi-layer structure; and a heat-curing adhering insulating material is used between foil layers, so that the low-voltage coil is solidified and becomes a fastening splint with a mechanical strength.

Still further, when short-circuit force is large, outer sides of the A-phase coil and the C-phase coil described in the present disclosure are each provided with a splint (clamp plate); and the splint and the low-voltage coil of corresponding phase constitute a splint pair and are bound by a binding strap, to clamp and fix the high-voltage coil of the corresponding phase. The formed "splint pair" can tightly clamp and fix the coil to greatly increase the ability of the coil to resist short circuit. Naturally, when the short-circuit force is small, the splints at the outer sides of the A- and C-phase coils can be eliminated, and the coils may be reinforced only with the banding straps.

Still further, U-shaped insulating paperboards are provided between the phases of the coils of the three phases of A, B and C described in the present disclosure, at the outer side of the A-phase coil, and at the outer side of the C-phase coil, respectively; and the U-shaped insulating paperboards each wrap the high-voltage coil and the low-voltage coil of the respective phase and then are bound by binding straps.

Still further, in order to completely clamp the high- and low-voltage coils so as to achieve the purpose of preventing movement of the transformer, the area of the splint described in the present disclosure is not less than the contact area with the high-voltage coil.

Still further, the binding strap described in the present disclosure is an insulating banding strap. The binding strap may be made of various types of high-strength insulating materials, such as PET straps (polyester binding straps), weftless tapes, and heat-shrinkable tubes.

The present disclosure has the following beneficial effects: 1. the solidified low-voltage foil-wound coil and the epoxy plate are used as splints, to prevent radial deformation of the coil during short-circuiting; 2. the high- and low-voltage coils are bound together by a binding strap to prevent the axial displacement of the coils during short-circuiting; 3. the cost of manufacturing the transformer is greatly reduced (the annual performance may amount to 500 million RMB or more, when estimated based on the actual production of 2.5-3.0 million amorphous transformers in China).

BRIEF DESCRIPTION OF DRAWINGS

The present disclosure will be further described below with reference to the accompanying drawings and embodiments.

In the figures: 1. A-phase coil; 2. B-phase coil; 3. C-phase coil; 4. U-shaped insulating paperboard; 5. PET strap; 6. insulating epoxy plate; 7-1. high-voltage coil; 7-2. low-voltage coil; 8. insulator between high-voltage coil and low-voltage coil.

DETAILED DESCRIPTION OF EMBODIMENTS

The present disclosure will now be described in further detail with reference to the accompanying drawings and preferred embodiments. These drawings are simplified schematic diagrams that only schematically illustrate the basic structure of the present disclosure, and thus only show the configurations relevant to the present disclosure.

Figure 1:
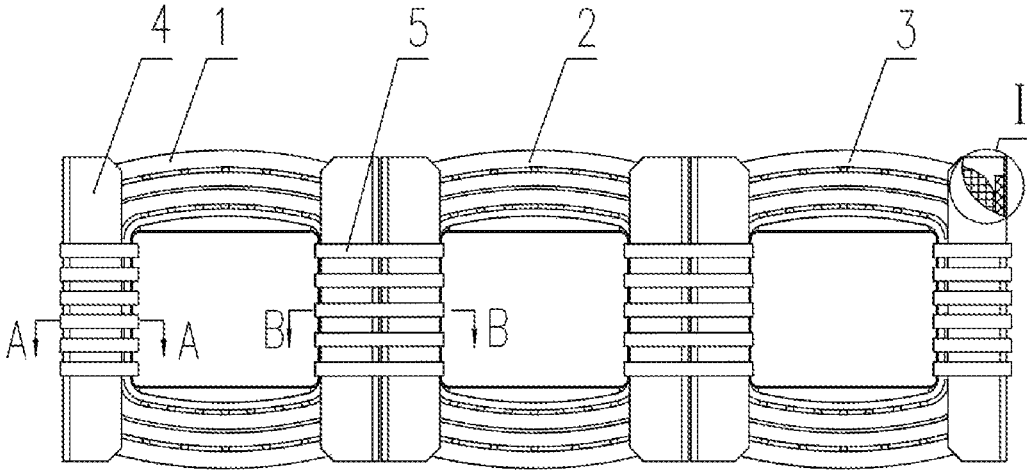
FIG. 1 is a schematic structural view of the present disclosure.
Figure 2:
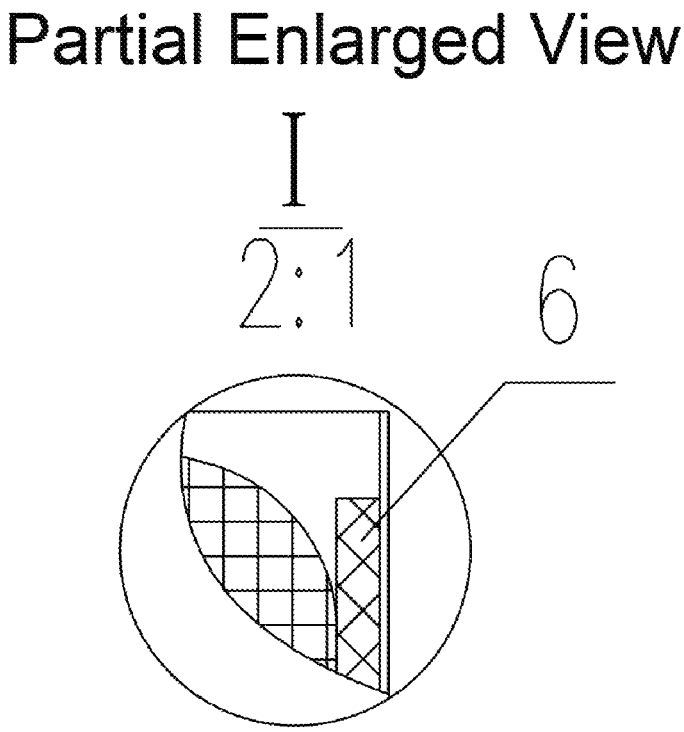
FIG. 2 is a partial enlarged view of part I in FIG. 1.
Figure 3:
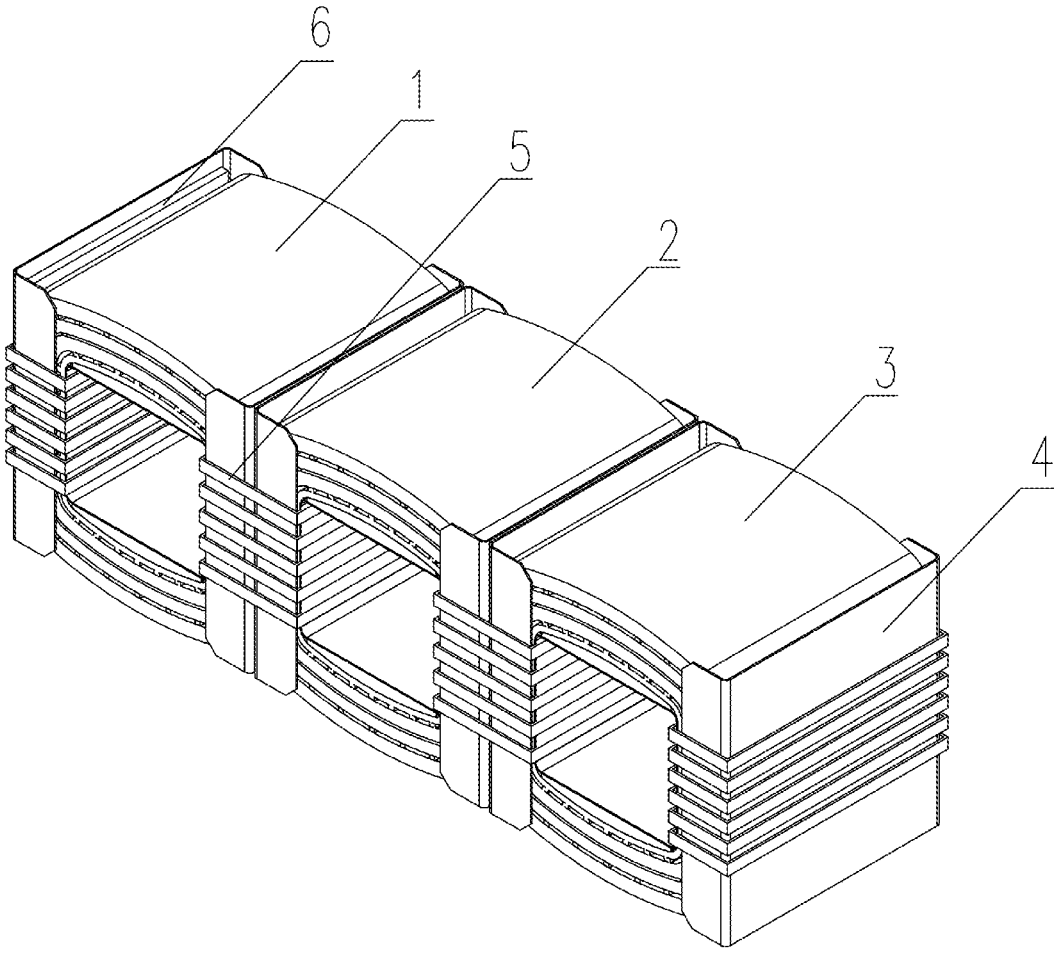
FIG. 3 is a schematic structural perspective view of the present disclosure.

As shown in FIGS. 1 to 3, a self-clamping structure for solving the short-circuit resistance problem of amorphous alloy transformers comprises an A-phase coil, B-phase coil and C-phase coil which are horizontally arranged, wherein the A-phase coil 1 is adjacent to and in close contact with the B-phase coil 2, and the B-phase coil 2 is adjacent to and in close contact with the C-phase coil 3. In FIG. 1, he A-phase coil, the B-phase coil and the C-phase coil each comprise a high-voltage coil located at an outer side thereof and a low-voltage coil located at an inner side thereof; the low-voltage coil is a foil-wound coil formed by winding copper foils, and is in a multi-layer structure; and a heat-curing adhering insulating material is used between foil layers, so that the low-voltage coil is solidified and becomes a fastening splint with a certain mechanical strength.

Figure 5:
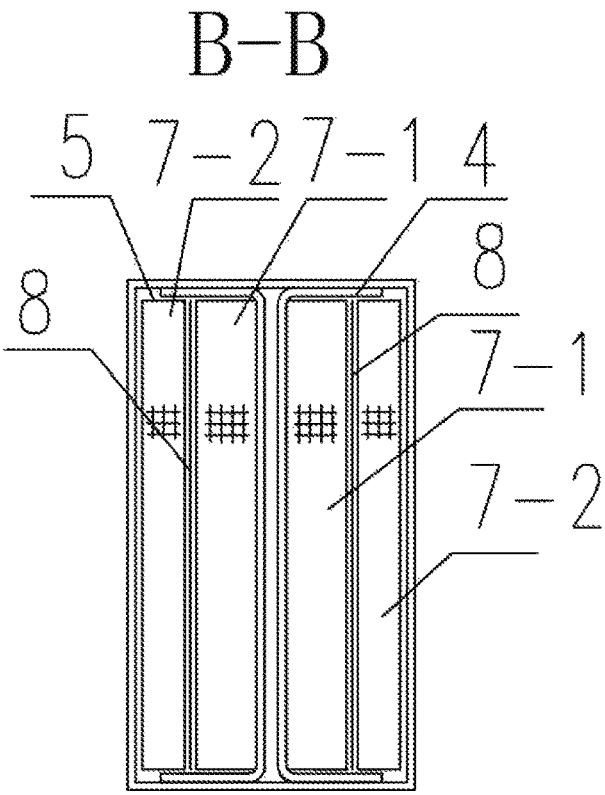
FIG. 5 is a sectional view taken along line B-B of FIG. 1.

A U-shaped insulating paperboard 4 is placed at a position where the A-phase coil 1 is adjacent to the B-phase coil 2, and then bound with a PET strap 5. As shown in FIG. 5, the low-voltage coils of two adjacent phases are bound to each other by the PET strap 5; and the low-voltage coils of two adjacent phases form a splint pair to clamp and fix the high-voltage coils of the two adjacent phases. The high-voltage coil 7-1 and the low-voltage coil 7-2 are fixed to form one piece after being bound. An insulator 8 between high-voltage coil and low-voltage coil is provided between the high-voltage coil 7-1 and the low-voltage coil 7-2. In FIG. 5, incomplete sections of the high-voltage coil 7-1 and the low-voltage coil 7-2 are shown.

Figure 4:
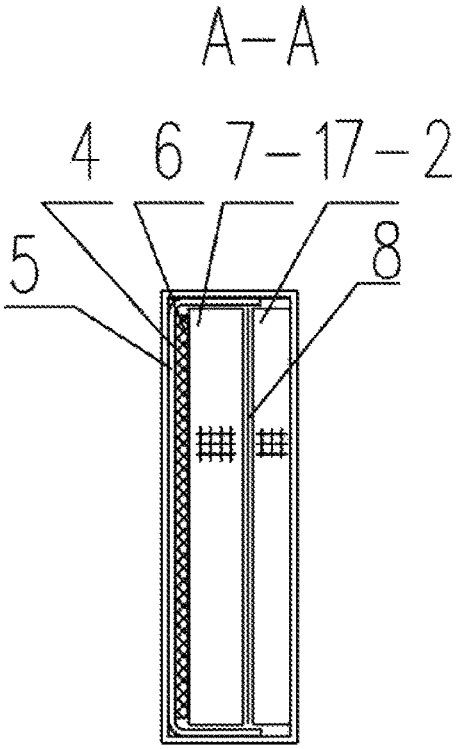
FIG. 4 is a sectional view taken along line A-A of FIG. 1.

FIG. 3 shows that when the short-circuit force is large, outer sides of the A-phase coil 1 and the C-phase coil 3 are each provided with an insulating epoxy plate 6. The insulating epoxy plate 6 and the low-voltage coil 7-2 of corresponding phase constitute a splint pair and are bound by a binding strap, to clamp and fix the high-voltage coil 7-1 of the corresponding phase, the structure of which is as shown in FIG. 4. Naturally, for a small-capacity product with relatively-small short-circuit force, the splints at the outer sides of the A- and C-phase coils can be eliminated, and the coils may be reinforced only with the banding straps. In FIG. 4, incomplete sections of the high-voltage coil 7-1 and the low-voltage coil 7-2 are also shown.

The present disclosure has a very good effect both in terms of resistance to radial short-circuit force and in terms of resistance to axial short-circuit force.

1. In terms of resistance to radial short-circuit force:

Traditional measures for resisting radial short circuit rely either on the strength of a coil conductor itself of a transformer, or on auxiliary structures (such as insulating cylinders, and stays) or the like added for passive support.

In contrast, in the present disclosure, a "structural splint" is formed using a low-voltage foil-wound coil by means of curing and adhesion of an interlayer insulator. Since the low-voltage coil is located at the inner side of the coil, the low-voltage coil solidified and shaped on the inner-diameter side can be used as a splint, to actively clamp and fix the coil, so as to prevent the radial deformation and displacement of the coil. Moreover, the low-voltage foil-wound coil is solidified into one piece, so that the low-voltage coil is not only an electrically operated element but also a structural splint, thereby eliminating an epoxy cylinder required in the prior structure, and having strength much higher than that of the epoxy cylinder.

For rectangular straight-side portions of the A- and C-phase coils at the outer sides thereof, a high-strength insulating plate with a height equal to that of the coil is added, as a splint, to the outer side of the high-voltage coil. This insulating splint and the solidified and shaped low-voltage coil of the corresponding phase constitute a "splint pairs", to actively clamp and fix the coil, so as to prevent the radial deformation and displacement of the coil. The "splint pair" structure actively clamps the high- and low-voltage coils, to prevent the deformation, displacement and damage of the coils of the transformer.

The binding of the splint and the insulator is performed by using a general-purpose PET strap, i.e., a polyester binding strap. It has high strength, low price, and good construction processability, and conveniently enables a firm "splint-splint" structure to be formed between the low-voltage coils of different phases, or between the low-voltage coil and the epoxy splint, so as to firmly fix the short-circuited high-voltage coil and low-voltage coil. Naturally, other materials may also be used instead of the PET strap; and the binding with the PET strap may be completed by strapping using a common strapping machine.

2. In terms of resistance to axial short-circuit force:

The PET strap is used to combine the high-voltage coil and the low-voltage coil of the transformer into one firm piece, so that while the coil is fixed in a radial direction by means of the "splint-splint" structure, the axial displacements of the high-voltage coil and the low-voltage coil are simultaneously restricted by the binding strap by means of the low-voltage coil and the splint, and thus an axial compression structure for the transformer can be eliminated, simplifying the structure and reducing the manufacturing cost.

The entire coil is bound by a simple and convenient method. Therefore, with the present disclosure, not only the short-circuit resistance problem of the amorphous alloy transformer is solved, but also the disclosure is simple in structure and convenient in construction, and the cost of manufacturing the transformer is greatly reduced, enabling a wide and huge social performance.

The above description describes only specific embodiments of the present disclosure, and various exemplary illustrations are not intended to limit the essence of the present disclosure. The specific embodiments described previously can be modified or varied by those of ordinary skill in the art after reading the description, without departing from the spirit and scope of the present disclosure.

The invention claimed is:

1. A self-clamping structure for solving a short-circuit resistance problem of an amorphous alloy transformer, comprising:

an A-phase coil, a B-phase coil and a C-phase coil which are horizontally arranged, wherein the A-phase coil is adjacent to and in close contact with the B-phase coil, and the B-phase coil is adjacent to and in close contact with the C-phase coil; and the A-phase coil, the B-phase coil and the C-phase coil each comprise a high-voltage coil located at an outer side thereof and a low-voltage coil located at an inner side thereof, wherein the low-voltage coil has certain mechanical strength after being solidified; the low-voltage coils of two adjacent phases are bound to each other by a binding strap; the low-voltage coils of two adjacent phases form a splint pair, to clamp and fix the high-voltage coils of the two adjacent phases; and the high-voltage coil and the low-voltage coil are fixed to form one piece after being bound, wherein outer sides of the A-phase coil and the C-phase coil are each provided with a splint, the splint being an insulating epoxy plate, the splint and the low-voltage coil of the corresponding phase constitute a splint pair and are bound by a respective binding strap to clamp and fix the high-voltage coil for the corresponding phase.

2. The self-clamping structure for solving a short-circuit resistance problem of an amorphous alloy transformer according to claim 1, wherein the low-voltage coil is a foil-wound coil formed by winding copper foils, and is in a multi-layer structure; and a heat-curing adhering insulating material is used between foil layers, so that the low-voltage coil is solidified and becomes a fastening splint with a mechanical strength.

3. The self-clamping structure for solving a short-circuit resistance problem of an amorphous alloy transformer according to claim 1, wherein U-shaped insulating paperboards are provided between phases of the A-phase coil, the B-phase coil and the C-phase coil, at the outer side of the A-phase coil, and at the outer side of the C-phase coil, respectively; and the U-shaped insulating paperboards each wrap the high-voltage coil and the low-voltage coil of the respective phase and then are bound by respective binding straps.

4. The self-clamping structure for solving a short-circuit resistance problem of an amorphous alloy transformer according to claim 1, wherein the binding strap is an insulating banding strap.

5. The self-clamping structure for solving a short-circuit resistance problem of an amorphous alloy transformer according to claim 1, wherein an area of the splint is not less than a contact area between the splint and the high-voltage coil.

6. The self-clamping structure for solving a short-circuit resistance problem of an amorphous alloy transformer according to claim 1, wherein the binding strap is made of a high-strength insulating material.

7. The self-clamping structure for solving a short-circuit resistance problem of an amorphous alloy transformer according to claim 6, wherein the high-strength insulating material is a polyester binding strap, a weftless tape or a heat-shrinkable tube.

8. The self-clamping structure for solving a short-circuit resistance problem of an amorphous alloy transformer according to claim 1, wherein the binding strap is configured to simultaneously restrict axial displacements of the high-voltage coil and low-voltage coil.

9. The self-clamping structure for solving a short-circuit resistance problem of an amorphous alloy transformer according to claim 1, wherein the splint is composed of an insulating splint and a solidified and shaped low-voltage coil of corresponding phase, wherein the insulating splint is a high-strength insulating plate having a height equal to that of the coil and added to the outer side of the high-voltage coil.

10. A self-clamping structure for solving a short-circuit resistance problem of an amorphous alloy transformer, comprising an A-phase coil, a B-phase coil and a C-phase coil which are horizontally arranged, wherein the A-phase coil is adjacent to and in close contact with the B-phase coil, and the B-phase coil is adjacent to and in close contact with the C-phase coil; and the A-phase coil, the B-phase coil and the C-phase coil each comprise a high-voltage coil located at an outer side thereof and a low-voltage coil located at an inner side thereof, wherein the low-voltage coil has certain mechanical strength after being solidified; the low-voltage coils of two adjacent phases are bound to each other by a binding strap; the low-voltage coils of two adjacent phases form a splint pair, to clamp and fix the high-voltage coils of the two adjacent phases; and the high-voltage coil and the low-voltage coil are fixed to form one piece after being bound, wherein the binding strap is made of a high-strength insulating material, wherein the high-strength insulating material is a polyester binding strap, a weftless tape or a heat-shrinkable tube.

11. The self-clamping structure for solving a short-circuit resistance problem of an amorphous alloy transformer according to claim 10, wherein the low-voltage coil is a foil-wound coil formed by winding copper foils, and is in a multi-layer structure; and a heat-curing adhering insulating material is used between foil layers, so that the low-voltage coil is solidified and becomes a fastening splint with a mechanical strength.

12. The self-clamping structure for solving a short-circuit resistance problem of an amorphous alloy transformer according to claim 10, wherein outer sides of the A-phase coil and the C-phase coil are each provided with a splint, the splint and the low-voltage coil of the corresponding phase constitute a splint pair and are bound by a respective binding strap to clamp and fix the high-voltage coil for the corresponding phase.

13. The self-clamping structure for solving a short-circuit resistance problem of an amorphous alloy transformer according to claim 10, wherein U-shaped insulating paperboards are provided between phases of the A-phase coil, the B-phase coil and the C-phase coil, at the outer side of the A-phase coil, and at the outer side of the C-phase coil, respectively; and the U-shaped insulating paperboards each wrap the high-voltage coil and the low-voltage coil of the respective phase and then are bound by respective binding straps.

14. The self-clamping structure for solving a short-circuit resistance problem of an amorphous alloy transformer according to claim 10, wherein the binding strap is an insulating banding strap.

15. The self-clamping structure for solving a short-circuit resistance problem of an amorphous alloy transformer according to claim 10, wherein an area of the splint is not less than a contact area between the splint and the high-voltage coil.

16. The self-clamping structure for solving a short-circuit resistance problem of an amorphous alloy transformer according to claim 10, wherein the binding strap is configured to simultaneously restrict axial displacements of the high-voltage coil and low-voltage coil.

17. The self-clamping structure for solving a short-circuit resistance problem of an amorphous alloy transformer according to claim 10, wherein the splint is composed of an insulating splint and a solidified and shaped low-voltage coil of corresponding phase, wherein the insulating splint is a high-strength insulating plate having a height equal to that of the coil and added to the outer side of the high-voltage coil.

* * * * *